US008110970B2

(12) United States Patent
Hsieh

(10) Patent No.: US 8,110,970 B2
(45) Date of Patent: Feb. 7, 2012

(54) LIGHT-EMITTING DEVICES UTILIZING GASEOUS SULFUR COMPOUNDS

(75) Inventor: Hung-Yuan Hsieh, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 317 days.

(21) Appl. No.: 12/611,887

(22) Filed: Nov. 3, 2009

(65) Prior Publication Data

US 2010/0123409 A1 May 20, 2010

(30) Foreign Application Priority Data

Nov. 18, 2008 (TW) ..... 97144474 A

(51) Int. Cl.
*H01J 1/50* (2006.01)

(52) U.S. Cl. ..... 313/161; 313/637; 315/248

(58) Field of Classification Search ..... 315/248; 313/153, 160, 161, 317, 567, 637
See application file for complete search history.

(56) References Cited

U.S. PATENT DOCUMENTS 4,071,798 A * 1/1978 Hammond ..... 313/18
5,072,157 A * 12/1991 Greb et al. ..... 315/248
5,404,076 A 4/1995 Dolan et al.
5,594,303 A 1/1997 Simpson et al.
5,757,130 A 5/1998 Dolan et al.
5,841,244 A * 11/1998 Hamilton et al. ..... 315/248
5,847,517 A 12/1998 Ury et al.
5,903,091 A * 5/1999 MacLennan et al. ..... 313/161

* cited by examiner

*Primary Examiner* — Thuy Vinh Tran

(57) ABSTRACT

A light-emitting device utilizing gaseous sulfur compounds is provided. This device includes a first substrate with an energy transmission coil disposed thereover, a dielectric barrier layer embedding underneath the energy transmission coil, a sealant wall circling around the dielectric barrier layer, a second substrate disposed against the first substrate and supported by the sealant wall, and a high-frequency oscillating power supply connected to the energy transmission coil. Normally the second substrate is a transparent substrate. Between the first and second substrates thereby defines an inner chamber, wherein a gaseous reactant comprising an inert gas and a sulfur-containing gas is filled. While powering up, the energy transmission coil induces an electromagnetic field within the inner chamber between the two substrates as causing decomposing/regenerating process cycles of sulfur molecules to lighting up the light-emitting device.

25 Claims, 10 Drawing Sheets

100

LIGHT-EMITTING DEVICES UTILIZING GASEOUS SULFUR COMPOUNDS

CROSS REFERENCE TO RELATED APPLICATIONS

This Application claims priority of Taiwan Patent Application No. 97144474, filed on Nov. 18, 2008, the entirety of which is incorporated by reference herein.

BACKGROUND OF THE INVENTION

1. Field of the Invention

The invention relates to light-emitting devices, and in particular to light-emitting devices utilizing gaseous sulfur compounds, wherein a discharge chamber is provided with no plasma-media contacting electrodes built inside the chamber.

2. Description of the Related Art

There are various types of lighting sources, e.g., an incandescent lamp using radiation associated with a burning filament, a fluorescent lamp composed of an electric discharge tube and a fluorescent-powder coating for energy conversion, a high-intensity-discharge (HID) lamp that induces electrical discharge within a highly-pressurized gas or steam, and an electrodeless plasma lighting system (PLS) lamp that generates lighting plasma of gaseous media with no media-contacting electrodes.

The various types of lamps have their respective advantages. For example, incandescent lamps are excellent in color rendition and small in size. Switching circuits of the incandescent lamps are simple and low cost. However, compared to other lamps, incandescent lamps are less power efficient and have a shorter life span. In the other end, fluorescent lamps are more power efficient in emitting light and more durable than other lamps. However, while compared with incandescent lamps, fluorescent lamps are relatively large in size. Additionally, fluorescent lamps require also additional power-ballasting circuits to stabilize discharge current and light output thereof. Other gas-discharge lamps like HID lamps are also power efficient and durable. The HID lamps require, however, a relatively long time for restriking on upon switching off. In addition, HID lamps, similar to fluorescent lamps, requires additional power-ballasting circuits to assist switching. Electrodeless PLS lamps possess longest life among all the above-noted lamps. The electrodeless PLS lamps though are acceptably efficient in emitting light but relatively much expensive. The electrodeless PLS lamps require also additional power-ballasting (though similar but more complex) circuits for switching.

One type of electrodeless PLS lamps, called electrodeless sulfur lamp, is particularly efficient in emitting white light of broadband spectrum even closely resembling to natural sun light.

U.S. Pat. Nos. 5,404,076, 5,594,303, 5,847,517 and 5,757,130, issued to Fusion System Corporation, discloses an electrodeless sulfur lamp.

The electrodeless sulfur lamps disclosed in the above noted US patents consist of a of golf-ball sized quartz bulb containing ten to hundred milligrams of sulfur powers and argon gas at an end of a spindle for rotation. The bulb absorbs microwave energy of 2.45 GHz generated from a magnetron to excite buffering gas of low pressure argon therein and generates gaseous discharging plasma. As a consequent, the space within the quartz bulb is thus supplied with an appropriate amount of free electrons. The sulfur powers absorb the microwave energy to heat and vaporize itself, thereby raising the pressure inside the quartz bulb to 5~10 times that of the surrounding atmosphere. The gaseous sulfur vapors elevate to a temperature in the quartz bulb under the continuous reaction with microwaves and plasmas of inert buffering gas and are thus stimulated to ionize and discharge. The sulfur ions vigorously oscillate within the space of a narrow mean free path and collapse within itself, thereby causing a molecular-type charge/discharge process, such a process is further aggravated by excitation and collision with highly energetic gas ions in the buffering gas plasma, thereby forming additional luminous thermal plasma of new media and emitting great amounts of photons, having a spectrum of about 73% of visible light, resembling to that of sunlight.

Nevertheless, the electrodeless sulfur lamps disclosed in the above noted US patents need a power source of more than 1.5 KW to reach a luminous efficiency of about 100 lumens per watt. As a result its application is confined to illuminate only large public spaces. In addition, the electrodeless sulfur lamps disclosed by the above noted US patents are normally large in size and appropriate means of electromagnetic shielding in most cases are mandatory, particularly for indoor applications. Therefore, the electrodeless sulfur lamps disclosed by the above noted US patents are not suitable for low power or planar luminance applications.

BRIEF SUMMARY OF THE INVENTION

Thus, a light-emitting device utilizing gaseous sulfur compounds is provided for low power or planar luminance applications.

An exemplary light-emitting device utilizing gaseous sulfur compounds comprises a first substrate with an energy transmission coil disposed thereover. A dielectric barrier layer is formed over the first substrate to cover the energy transmission coil. A sealant wall circles around the dielectric barrier layer. A second substrate is disposed against the first substrate and supported by the sealant wall, thereby defining an inner chamber between the first and second substrates, wherein the second substrate is a transparent substrate. A gaseous reactant is filled in the inner chamber, wherein the gaseous reactant comprises an inert gas and a sulfur-containing gas. A high-frequency oscillating power supply is coupled to the energy transmission coil, thereby allowing the energy transmission coil to induce an electromagnetic field into the inner chamber for lighting up the light-emitting device.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
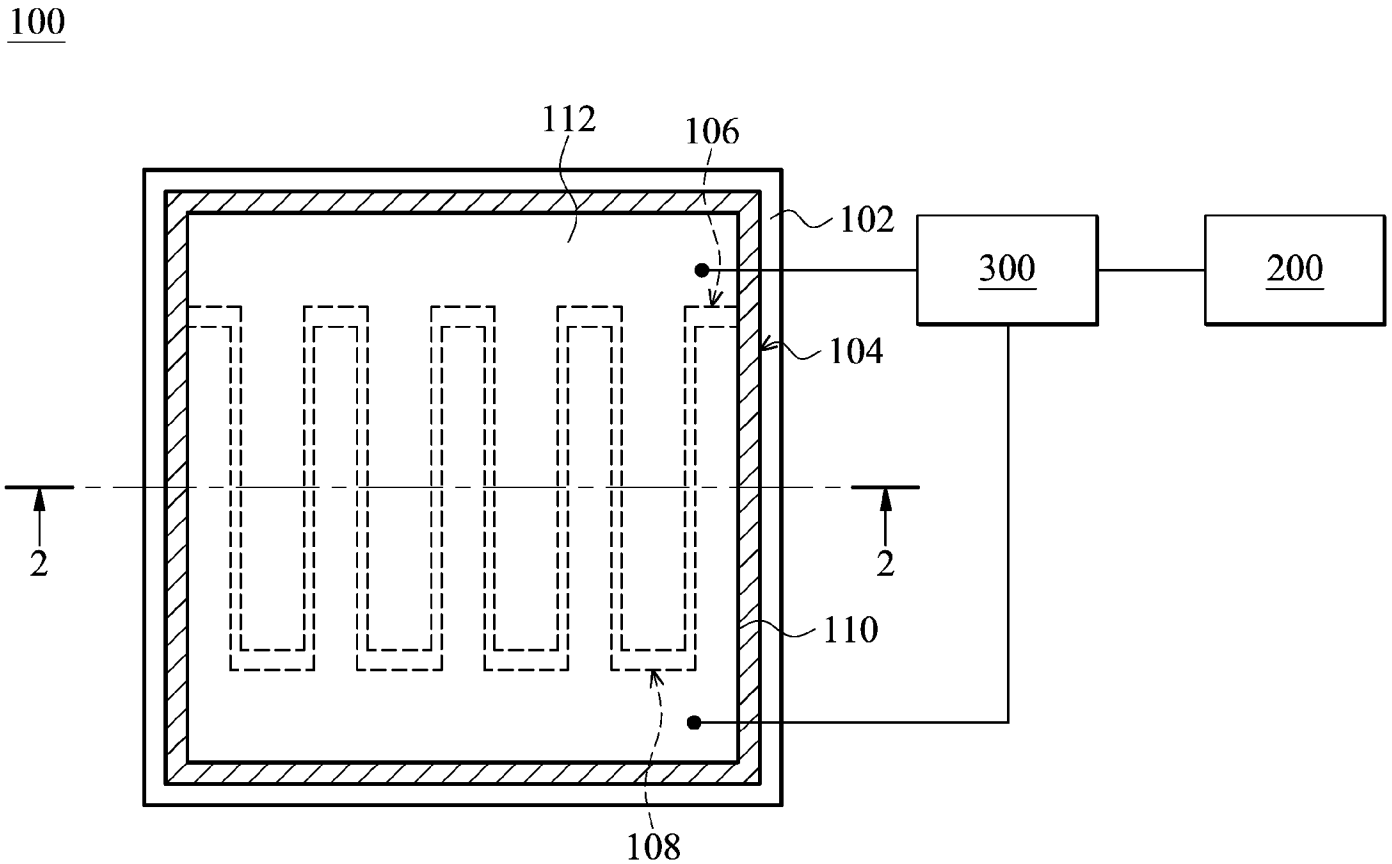
FIG. 1 is a schematic diagram showing a top view of a light-emitting device according to an embodiment of the invention.

FIG. 1 is a schematic diagram showing a top view of an exemplary light-emitting device 100. As shown in FIG. 1, the light-emitting device 100 comprises a substrate 102, an energy transmission coil (illustrated as two electrically isolated electrodes 106 and 108) disposed over the substrate 102, a dielectric barrier layer 112 disposed over the substrate 102 and embedding the energy transmission coil, a sealant wall 110 which circles around the dielectric barrier layer 112 over the substrate 102, and a high-frequency oscillating power supply 200. An impedance matching circuit 300 may be optionally provided between the energy transmission coil and the high-frequency oscillating power supply 200 to improve energy transmission efficiency. The electrodes 106 and 108 of the energy transmission coil are connected to the impedance matching circuit 300 to receive power transmission from the high-frequency oscillating power supply 200. FIG. 1 illustrates the substrates 102 and 104 as substantially rectangular shape from a top view. However the shape of the substrates 102 and 104 are not limited thereto. The substrates 102 and 104 can be configured into, for examples, other orthogonal geometries or a substantially circular shape from a top view.

Figure 2:
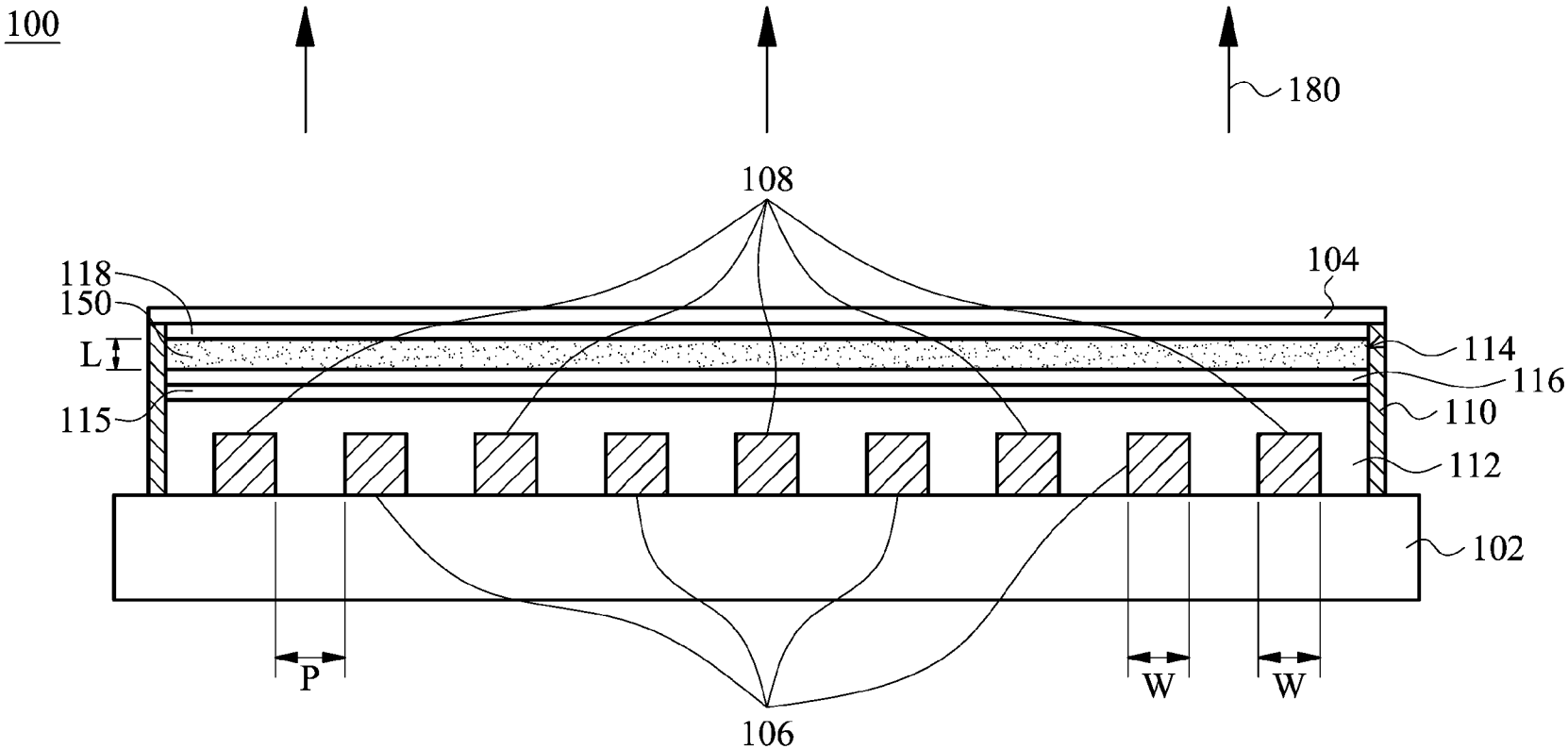
FIG. 2 shows a cross section taken along line 2-2 in FIG. 1.

FIG. 2 shows a cross section taken along line 2-2 of the light-emitting device 100 in FIG. 1. As shown in FIG. 2, the substrate 104 and the substrate 102 are assembled together with a sealant wall 110 which thereby defines an inner chamber 114 there in between. The substrate 104 is a transparent substrate and the material thereof can be, for example, quartz, borosilicate, or translucent alumina which transmits visible light. The substrate 104 is formed with a thickness of about 1.5~5.0 mm. On the other end, the substrate 102 is an electrically-insulative substrate and material thereof can be, for example, quartz, glass, or ceramic. In the inner chamber 114 defined between these two substrates (102 and 104), a gaseous reactant 150 is filled for purposed as media of lighting plasma. The gaseous reactant 150 is a mixture comprising of at least a buffer gas and a sulfur-containing gas. The buffer gas can be, for example, inert gases such as He, Ne, Ar, Kr, Xe, Rn, or combinations thereof. And the sulfur-containing gases can be, for example, $SF_4$ or $SF_6$. The buffer gas may be formed with only one kind of inert gas or ideally a combination of at least two kinds of inert gases. A blending of more than one inert gases is for example combining Ar or Kr taken from a group of higher molecular weight with He or Ne taken from another group of low molecular weight. A plasma can be easily ignited at low power by an inert gas of lower molecule weight (M.W.) to rapidly reach enough free electron density at starting stage. Meanwhile upon excited within the plasma atmosphere, inert gas having high M.W. may supply energetic ions having high momentum to continuously strike the sulfur-containing gas which is relatively immobile, and by such an action to knock fluorine ions out of the sulfur-containing gas. The released active fluorine ions may then recombine with ions of the inert gas of high M.W. to temporarily produce metastable fluoride such as ArF or KrF. Such a decomposing/regeneration process gradually brings forth sulfur ions out of the plasma atmosphere. The buffer gas and the sulfur-containing gas in the gaseous reactant 150 are blended with a mix ratio of about 100:0.1~2:1. The weighting of the inert gas having high M.W. in the buffer gas should be adjusted according to the proportioning of sulfur-containing gas in order to completely consume the fluorine ions released during the above noted decomposing/regenerating process. The inner chamber 114 is preferably sustained at a pressure of about 0.01~1 atm.

Still referring to FIG. 2, the electrodes 106 and 108 disposed over the substrate 102 constitutes an energy transmission coil which is connected to the high frequency oscillating power supply 200 (See FIG. 1). The high frequency oscillating power supply 200 may be, for example, an acoustic frequency oscillator, a radio frequency (RF) oscillator, or a microwave frequency oscillator. An impedance matching circuit 300 may be optionally provided between the electrodes (106 and 108) and the high-frequency oscillating power supply 200 to improve energy transmission efficiency. The impendence matching circuit 300 matches impendence between the high-frequency oscillating power supply 200 and loadings inferred from the electrodes 106 and 108. If so arranged, the energy transmission coil could then be supplied with electro-magnetic power of pulses having a frequency of about 1 KHz~20 MHz, or more preferably of about 5 KHz~2 MHz. The electromagnetic pulses so provided can be either in DC or AC pulses. Such a powering up generates capacitively coupling effects, as forming a local electrical field within the inner chamber 114 to excite the gaseous reactant therein and cause charging/discharging process cycles which result in the emitting of light 180. Herein, the dielectric barrier layer 112 embedding the electrodes 106 and 108 must be transmissive to the electromagnetic field having a frequency between 1 KHz~20 MHz supplied from the high-frequency oscillating power supply 200. The dielectric barrier layer 112 is made out of hybrid compounds by mixing inorganic dielectric powders such as silicon dioxide, barium titanate, aluminum oxide, titanium dioxide, magnesium oxide, or glass, with an organic binder such as silicon resin, epoxy resin, acrylic resin, PU resin or furan resin, etc. The dielectric barrier layer 112 is deposited on the substrate 102 by first screen printing of a raw-mixture paste and later applying high temperature baking to burn off the binder as causing particle sintering to form a continuous thick film which buries the energy transmission coil (displayed as electrodes 106 and 108) underneath. Similar to the dielectric barrier layer 112, the sealant wall 110 may be made out of hybrid compounds by mixing inorganic powders such as silicon dioxide, magnesium oxide, aluminum oxide, silica gel or glass with an organic binder such as silicon resin, epoxy resin, acrylic resin, PU resin or furan resin, etc. The sealant wall 110 is formed by first screen-printing or casting, or dispensing a raw mixture pastes on the substrate 102 and later applying high temperature baking to burn off the binder as causing particle sintering to form a continuous and airtight sealing support between the substrates 102 and 104. Herein, the dielectric barrier layer 112, the sealant wall 110 and the substrate 102 must have close thermal expansion characteristics to avoid undesired deformation which might otherwise result in bending or leakage, while operating the light-emitting device 100.

In addition, an optional light reflection layer 115 and/or a secondary-electron emitting layer 116 can be sequentially deposited over the top of the dielectric barrier layer 124 as directly meeting with the gaseous reactant 150 to direct illumination and to improve power utilization efficiency. The light reflection layer 115 may be made from simple metal oxides such as titanium dioxide ($TiO_2$) or from a multi-layered dichroic coating, which utilizes interference of light via media of contrast refraction, such as $TiO_2$—$SiO_2$ to redirect out-scattered light for illumination. The secondary-electron emitting layer 116 may be made from aluminum oxide or magnesium oxide to purposely increase electron density and lighting plasma intensity of the light-emitting device 100.

Individual thicknesses of the light reflection layer 115 or the secondary electron emitting layer 116 is preferably no more than 1 μm. Similar to the dielectric barrier layer 112, the above supplementary layers (115 and 116) must also be transmissive to the input electromagnetic wave from the high-frequency oscillating power supply 200 for excitation of the gaseous reactants 150 to form lighting plasma.

A possible reaction mechanism of the light-emitting device 100 as shown in FIGS. 1 and 2 is described as follows. Inside the inner chamber 114, the energy transmission coil is biased to first excite the inert gas with relatively low molecular weight (M.W) to form a starting plasma thereof which rapidly raises the free electron density in the plasma to a sufficient level. Meanwhile upon excited within the plasma atmosphere, another inert-gas ingredient of relatively high M.W. may subsequently supply energetic ions having high momentum to continuously strike the sulfur-containing gas which is relatively immobile. And by such an action it causes decomposition to occur which allows free fluorine atoms or ions to escape from the sulfur-containing gas molecules. Consequently such frequent and vigorous collisions produces various charged molecules such as $SF_5^+$, $SF_4^+$, $SF_2^+$ or $SF^+$ as products in sequence of progressive stages. The released active fluorine ions (negatively charged) may then recombine with positively charged ions of the inert gas of high M.W. to temporarily produce metastable fluoride such as ArF or KrF. Such a decomposing/regenerating process gradually brings forth sulfur ions out of the plasma atmosphere. Since the molecular weight of the sulfur containing reactant is reduced due to the decomposition and liberation of the fluorine ions, vigorous oscillation of the resulting free sulfur ions thus become possible in response to the electromagnetic field just like ions of other inert gases. Excited by a electromagnetic wave of suitable frequency (e.g., 1 KHz~1 MHz) and vigorously self-vibrated within space of narrow mean free path, the free sulfur ions with high momentum would frequently collide with other free sulfur ions and recombine into another multi-atomic molecular species. Such a three-body collision of atoms, ions, and electrons eventually forms charged diatomic sulfur radicals in an metastable and/or excited state. These ionization and recombination process cycles continuously increases in intensity and releases great amounts of photons which emit light 180. High luminous efficacy is achieved as greater than 73% of light 180 is located within the visible range. Unlike traditional sulfur lamp which use solid-state sulfur powder as discharge media requiring preheating to vaporize, the light-emitting device 100 of this invention does not waste energy for phase exchange or intentionally raise temperature to trigger the three-body collision process. Therefore, operating temperature in the light emitting device 100 is greatly reduced as achieving a non-thermally equivalent plasma lighting at a low pressure.

Figure 3:
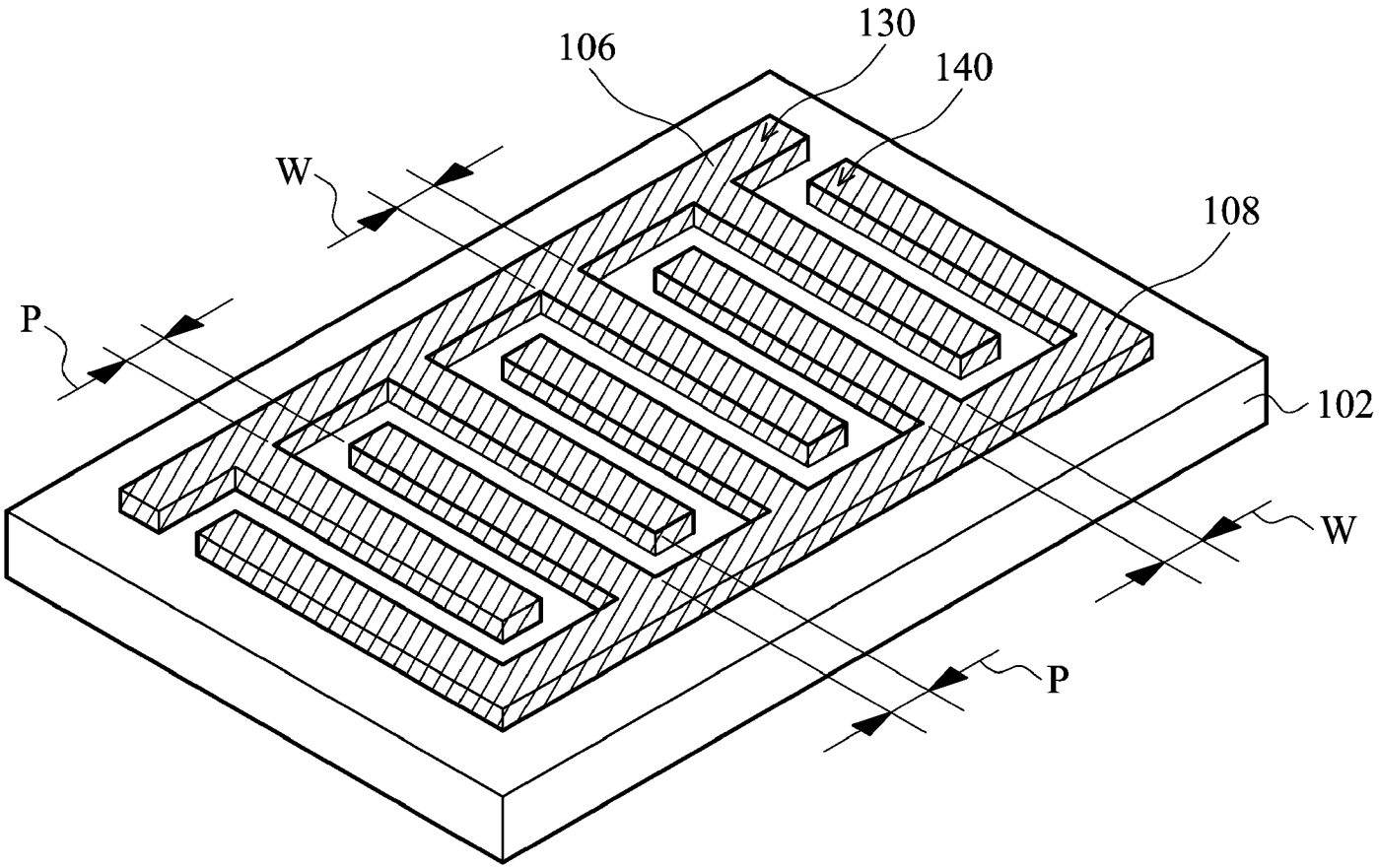
FIG. 3 is a schematic diagram showing a top view of an energy transmission coil according to an embodiment of the invention.

FIG. 3 is a schematic drawing showing a top view of the electrodes 106 and 108 which constitutes the energy transmission coil. The electrodes 106 and 108 are electrically isolated two ends of opposite polarity. The electrodes 106 and 108 are configured as an interconnecting comb-like pattern when viewed from a top view. The electrodes 106 and 108 can be make from conductive metals such as copper foil or sintered thick films of pastes containing conductive particles such as silver, palladium or transparent conductive oxides such as indium tin oxide (ITO). Each segment of electrodes 106 and 108 may be formed with a line width W of about 0.1~5 mm and a pitch P of about 0.05~25 mm there in between. A terminal 130 of the electrode 106 and a terminal 140 of the electrode 108 are connected onto output terminals (not shown) of the high-frequency oscillating power supply 200 (not shown). Herein, the energy transmission coil is illustrated as a power conducting device disposed over the substrate 102 and protruding thereof. But it is not limited to only such a configuration. For example, the energy transmission coil can also be embedded within the substrate 102. Such a buried configuration may improve flatness of composing elements and ease to integrate the light-emitting device 100 for particular applications such as in flat panel displays or projectors.

Moreover, to overcome the high dielectric strength before breakdown of the sulfur-containing reactant, a shorter pitch P may be applied as to effectively increase local electrical-field strength between the two electrodes 106 and 108. Such an arrangement is beneficial in promoting the excitation and stability of the plasma. In addition, the short-pitched electrodes are also accommodative to be buried under a thin dielectric barrier layer 112, as illustrated in FIG. 2, by means of sequential screen printing to form a structure of dielectric barrier discharge (DBD). By such, the gaseous reactant 150 in the inner chamber would be most effectively excited by the energetic electrons without causing arcing or streaming within a local region of relatively high electrical field which is located just above the embedded electrodes under the thin dielectric barrier 112. And a critical voltage for igniting the plasma and power consumption can be greatly reduced. In addition, since the high electrical field suitable for excitation is just above a top surface of the electrodes of the energy transmission coil, the plasma so formed is non-diffusive but constricted within a local neighborhood between the electrodes. Thus the space height L for filling the gaseous reactants 150 can be shortened to even below 1 mm. Consequently, the overall thickness of the light-emitting device 100 can be reduced by applying a tabular sealant wall 110 of a small aspect ratio. Such a configuration greatly simplify supporting and sealing process for a planar vacuum device of a large area.

Arrangement of the electrodes 106 and 108 of the energy transmission coil in the light emitting device 100 are not limited by the coplanar interconnecting comb-like configuration as illustrated in FIG. 3.

Figure 4:
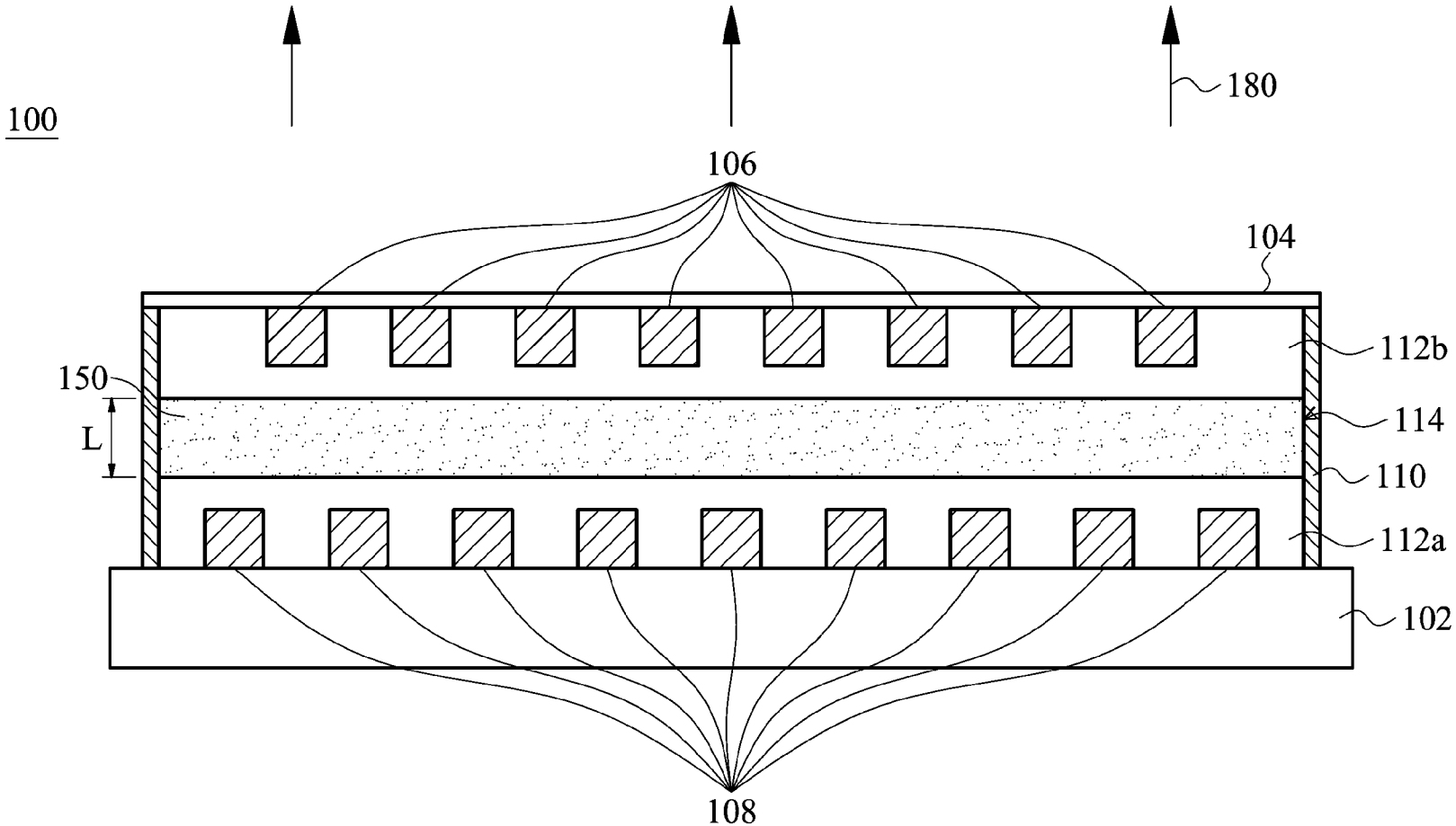
FIG. 4 is a schematic diagram showing a cross section of a light-emitting device according to another embodiment of the invention.
Figure 5:
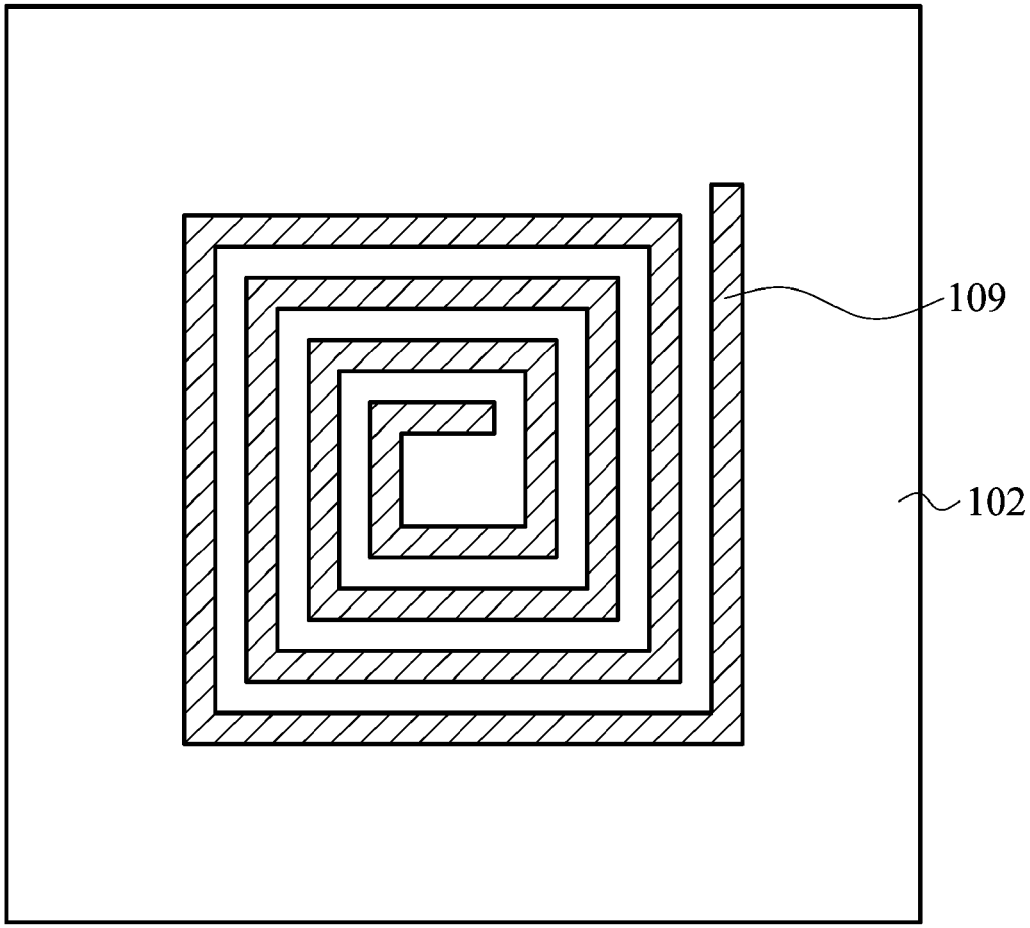
FIGS. 5-10 are schematic diagrams showing top views of an energy transmission coil in various embodiments of the invention, respectively.
Figure 6:
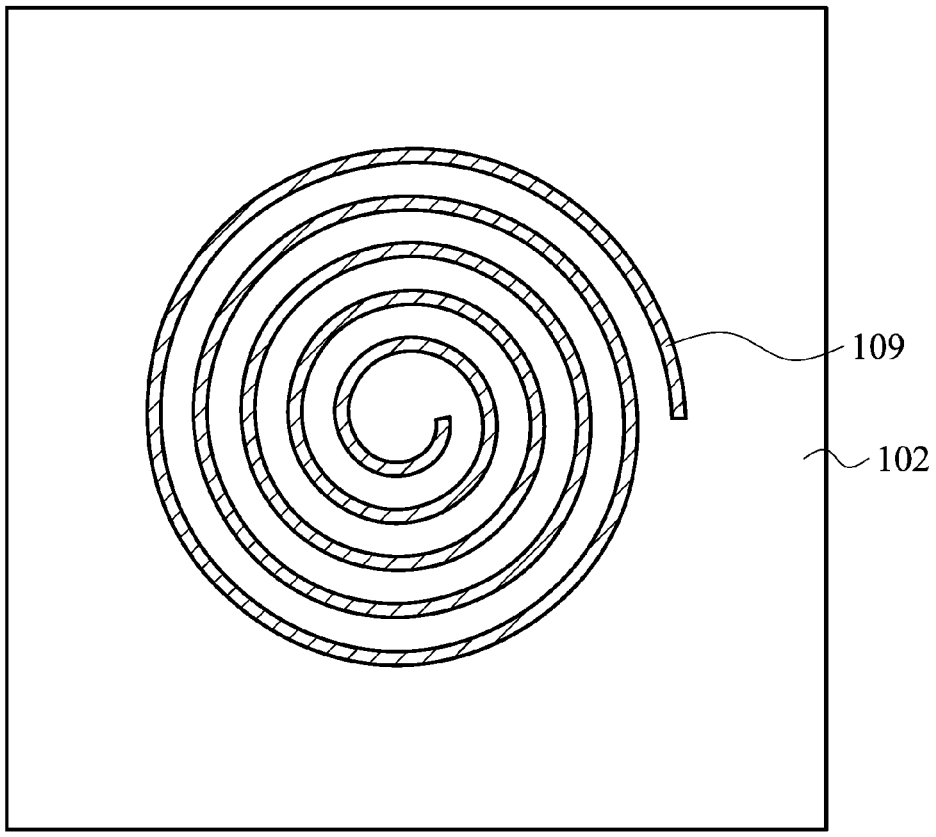
Figure 7:
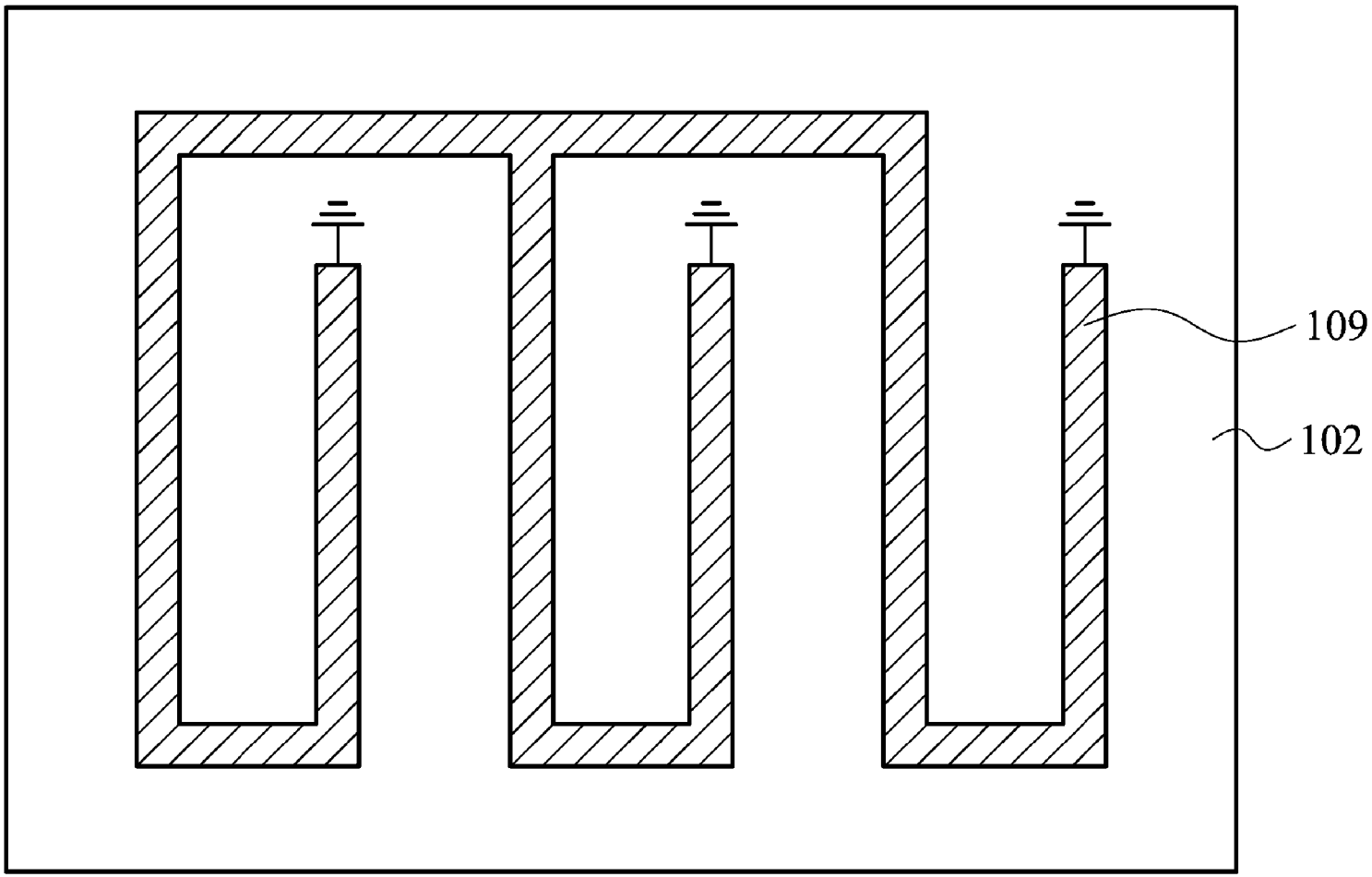
Figure 8:
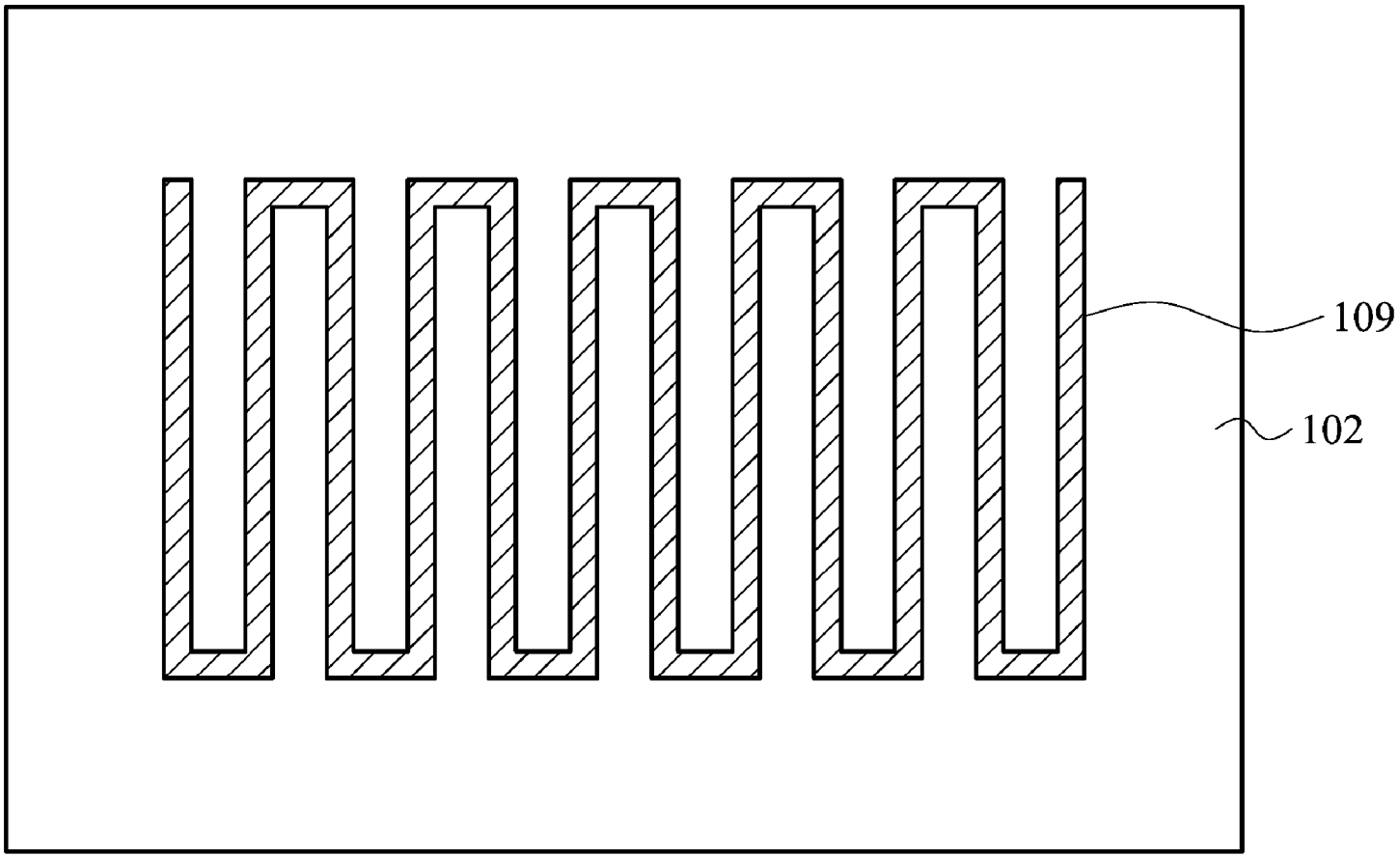
Figure 9:
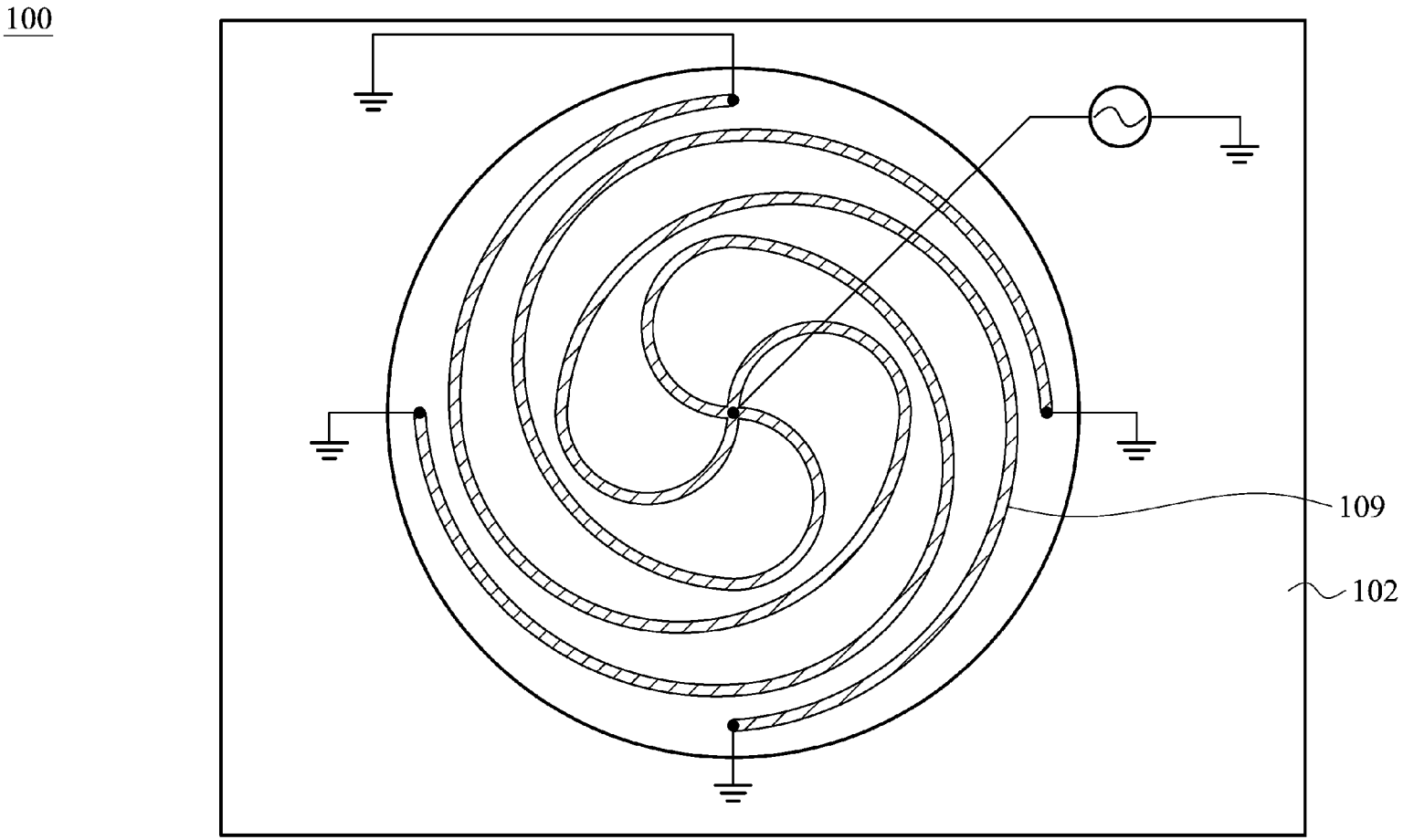
Figure 10:
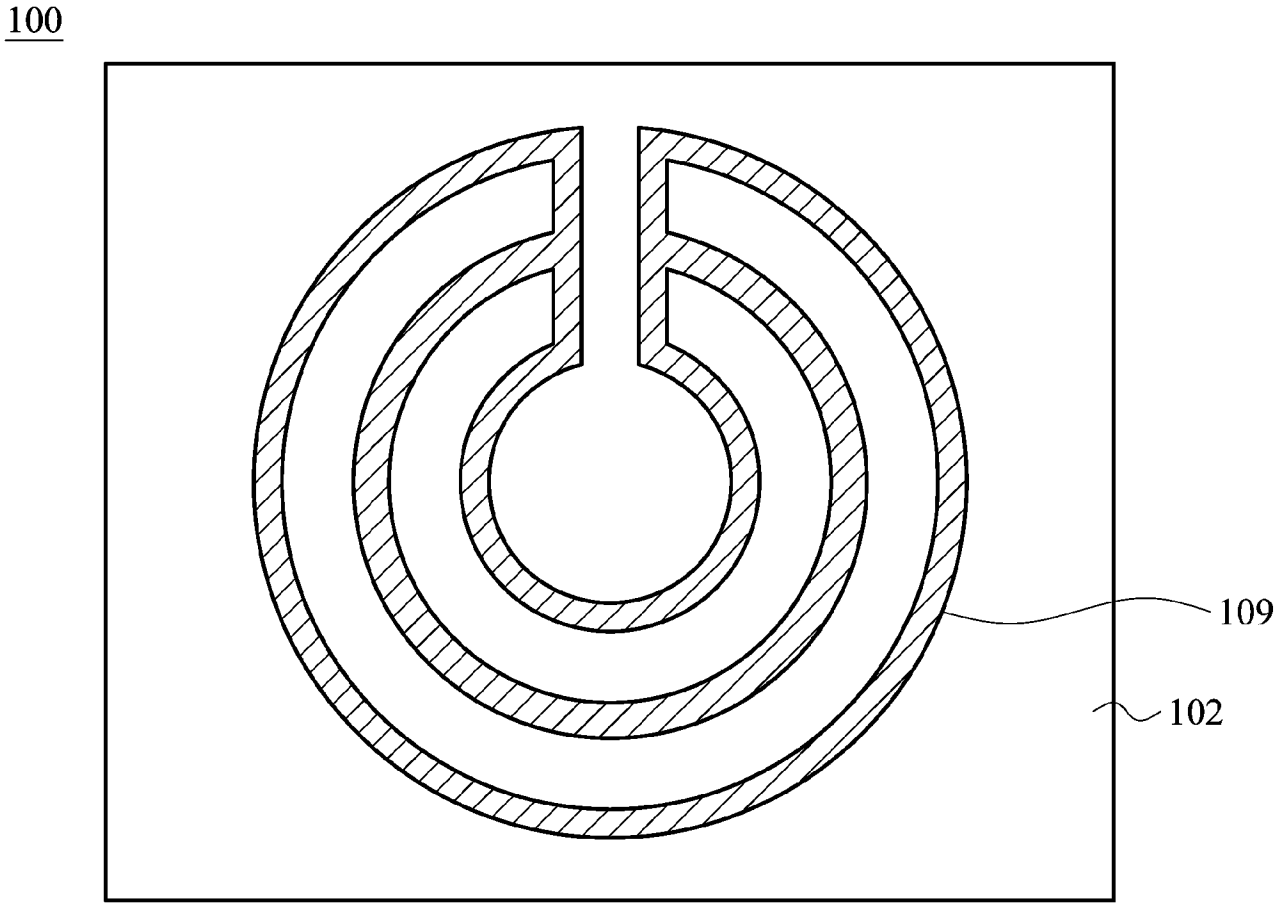

FIG. 4 is a schematic drawing showing the electrodes 106 and 108 disposed on different substrates, respectively. As shown in FIG. 4, the electrodes 106 and 108 are disposed on the substrates 104 and 102 and are embedded under the dielectric barrier layers 112*a* and 112*b*, respectively. A gaseous reactant 150 is filled within an inner chamber defined between the dielectric barrier layers 112*a* and 112*b*. In this embodiment, a lower structure comprising the dielectric barrier layer 112*a* and the electrode 180 is similar to that disclosed in the previous embodiment shown in FIG. 3. An upper structure comprising electrode 106 and the dielectric barrier layer 112*b* must, however, be made with light transparent materials. The electrode 106 may be made from transparent conductive materials such as tin oxide, indium oxide, zinc oxide, or tin fluoride, etc. The dielectric barrier layer 112*b*, in the other end, may be made from transparent insulative materials such as silicon resin, glass, acrylic resin, or epoxy resin, etc.

The arrangement of the electrodes 106 and 108 on different substrates can be configured as an interconnecting comb on two different planes as illustrated in FIG. 4. Herein the electrodes 106 and 108 are embedded by different dielectric barrier layers 112*a* and 112*b*, respectively. The electrodes 106 and 108 may also be arranged in other configuration (not shown) such as positioned the two electrodes in a same orientation with no horizontal displacement, or in a perpendicular manner like a chessboard when viewed from a top view.

The electrodes can be so configured as interconnecting fingers or grids for a proper capacitively coupling of input energy for excitation of gas plasma where the intensity of an induced electrical field varies with vertical distance L in space filled with the gaseous reactants 150.

Moreover, the energy transmission coil in the light emitting device 100 is not limited only to configurations for achieving capacitively coupling effects of input energy as described above. The energy transmission coil may also be configured for obtaining an inductively coupling effect of input energy using a single continuous electrode 109 such as those shown in FIG. 5-10. As shown in FIG. 5-10, the electrode 109 of the energy transmission coil in the light emitting device 100 is configured as other shapes such as a substantially rectangular helix loop (See FIG. 5), a substantially circular helix loop (See FIG. 6), a U-shaped line (See FIG. 7), a meander (serpentine) line (See FIG. 8), a S-shaped line (See FIG. 9) or even multiplexed parallel lines (See FIG. 10. All such are capable of inducing inductively coupling effects for a lighting plasma.

The light-emitting device 100 has a high luminous efficacy and a color rendition that resembles sunlight. The light-emitting device 100 shows a wavelength distribution better match with the luminous sensitivity equivalence of human eyes than most of conventional fluorescent lamps does. Since the light-emitting device of current invention may directly emit visible white light, there is no need to coat fluorescent conversion materials on the chamber wall of the inner chamber 114 or to use environmentally hazardous mercury material. The light-emitting device 100 also shows a minimal aging characteristics over the life span thereof in both color and brightness of the emitted light.

Thus, planar lighting sources with high energy efficiency may be fabricated using the light-emitting device 100 of the invention adopting high efficient luminous discharge of sulfur molecules. The light-emitting device 100 of the invention incorporates a planar energy transmission coil to provide capacitively-coupled electrical fields for a powerful excitation. Besides, because there is no electrode contacting with the gaseous reactant 150 inside the inner chamber 114 in the light emitting device 100, degradation of electrodes with plasma atmosphere is completely avoided. In addition, since the inner chamber 114 is fully sealed, no chemical contaminants could be formed therein during the plasma discharging process, thereby ensuring a durable life span and reliability thereof.

The light emitting device 100 may also take advantages of metastable products formed by the recombination of liberated fluorine ions with the ions of the inert buffer gases (e.g. Ar or Kr) to modulate the colors of emitted light. For example upon excited, a metastable product like KrF radiates a UV light peaking at a wavelength of about 249 nm which is so close to the 254 nm from mercury used in common fluorescent lamps. Therefore, traditional tri-chromatic (RGB) rare-earth-doped phosphors may be applied extensively to modify the spectrum of light output thereof without need of using mercury. Such a UV-to-visible converting fluorescent layer 118 (as illustrated in FIG. 2) capable of enhancing brightness or modify color spectrum of the light output may be optionally deposited over an inner surface of substrate 104 at location in close contact with the gaseous reactant 150 and its associated plasma. The UV-to-visible converting fluorescent layer 118 which adopts traditional rare-earth doped phosphors may converts UV radiation from intermediate products (ArF or KrF) in the plasma into visible light by taking advantage of its similar UV emission peak as from mercury in most fluorescent lamps.

The light-emitting device 100 of the invention is thus applicable in applications such as concentrated type or planar type lighting sources. For applied the light emitting device 100 of the invention as a planar lighting source in a backlight module, no diffusion plates or brightness enhancing films would be required as normally necessary while using conventional tubular CCFL as light-emitting source. Therefore, fabrication costs could be decreased, while increasing luminous efficacy and power utilization efficiency of the backlight module. In addition, the light-emitting device 100 of the invention can served as an alternative which directly emits visible light using no wavelength converting fluorescent materials as commonly adopted in conventional cold cathode fluorescent lighting (CCFL) or in flat FED displays. Therefore unfavorable effects such as poor uniformity, aging of phosphors, instability and distortion of color, and erosion of electrodes commonly observed in conventional fluorescent lighting may then be prevented. The energy input to the light-emitting device 100 of the invention is directly converted into visible white light with no other middle stages for adjusting wavelength. The light-emitting device 100 of the invention can be further improved by adding peripheral electromagnetic shields (not shown) or other complementary components outside of the substrates 102 and 104 to enrich functionality of the light emitting device 100.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light-emitting device utilizing gaseous sulfur compounds, comprising:

a first substrate;

an energy transmission coil disposed over the first substrate;

a dielectric barrier layer, overlying the first substrate and covering the energy transmission coil;

a sealant wall circling around the dielectric barrier layer;

a second substrate disposed against the first substrate and supported by the sealant wall, thereby defining an inner chamber between the first and second substrates, wherein the second substrate is a transparent substrate;

a gaseous reactant filled in the inner chamber, wherein the gaseous reactant comprises an inert buffering gas and a sulfur-containing gas; and a high-frequency oscillating power supply coupled to the energy transmission coil, thereby allowing the energy transmission coil to induce an electromagnetic field into the inner chamber for lighting up the light-emitting device.

2. The light-emitting device as claimed in claim 1, further comprising an impedance matching device coupled between the energy transmission coil and the high-frequency oscillating power supply to improve energy transmission efficiency.

3. The light-emitting device as claimed in claim 1, wherein the dielectric barrier layer is transmissive to electromagnetic waves having a frequency ranging about 1 KHz to 20 MHz.

4. The light-emitting device as claimed in claim 1, wherein the dielectric barrier layer comprises a fully-cured mixture of blending inorganic dielectric powders with an organic binder, or a sintered product of the mixture.

5. The light-emitting device as claimed in claim 1, wherein the dielectric barrier layer and the first substrate have close-matched thermal expansion coefficients.

6. The light-emitting device as claimed in claim 1, wherein the sealant wall and the first substrate have close-matched thermal expansion coefficients.

7. The light-emitting device as claimed in claim 1, wherein the inner chamber is a hermetically sealed space filled with the gaseous sulfur-containing reactants, and an electrical field is generated within the inner chamber by capacitively coupling with input energy from the high-frequency oscillating power supply via the energy transmission coil, which conveys AC or DC pulses having a frequency of about 1 KHz-20 MHz to excite the gaseous reactants for forming a lighting plasma.

8. The light-emitting device as claimed in claim 1, wherein the second substrate comprises quartz, borosilicate and soda lime.

9. The light-emitting device as claimed in claim 1, wherein the inert buffering gas comprises He, Ne, Ar, Kr, Xe, Rn or combinations thereof.

10. The light-emitting device as claimed in claim 1, wherein the inert buffering gas is a combination of at least two kinds of inert gases by blending Ar or Kr with He or Ne.

11. The light-emitting device as claimed in claim 1, wherein the sulfur-containing gas comprises $SF_4$, $SF_6$ or other sulfur fluorides.

12. The light-emitting device as claimed in claim 1, wherein the buffering gas and the sulfur-containing gas in the gaseous reactant are blended with a mix ratio of about 100: 0.1~2:1.

13. The light-emitting device as claimed in claim 1, wherein the energy transmission coil has an interconnecting comb configuration when viewed from a top view.

14. The light-emitting device as claimed in claim 1, wherein the energy transmission coil has a plurality of electrodes, having a space of about 0.01~25 mm there in between.

15. The light-emitting device as claimed in claim 1, wherein the energy transmission coil has a plurality of electrodes having respectively a line width of about 0.01-5 mm.

16. The light-emitting device as claimed in claim 1, wherein the energy transmission coil has a plurality of electrodes having different polarity ends, and the electrodes are disposed solely on the first substrate or respectively over the first and second substrates.

17. The light-emitting device as claimed in claim 1, wherein the energy transmission coil is formed as a rectangular helix loop, a circular helix loop, a U-shaped line or a meander line when viewed from a top view.

18. The light-emitting device as claimed in claim 1, wherein the energy transmission coil comprises conductive metals or transparent conductive oxides.

19. The light-emitting device as claimed in claim 1, wherein the inner chamber has a pressure of about 0.01-1 atm.

20. The light-emitting device as claimed in claim 1, wherein the light emitting device emits visible light.

21. The light-emitting device as claimed in claim 1, further comprising a light reflection layer disposed between the dielectric barrier layer and the gaseous reactants to modulate the direction of the emitted light.

22. The light-emitting device as claimed in claim 21, further comprising a secondary electron emitting layer disposed between the light-reflection layer and the gaseous reactant to increase a plasma density and amounts of light output.

23. The light-emitting device as claimed in claim 22, wherein the light reflection layer and the secondary electron emitting layer are both transmissive to the electromagnetic field induced from the energy transmission coil, thereby allowing the electromagnetic field to interact with the gaseous reactants for excitation of lighting plasma.

24. The light-emitting device as claimed in claim 1, further comprising a UV-to-visible converting fluorescent layer disposed between inner surface of the second substrate and the gaseous reactants to enhance brightness or to modify color spectrum of the light output.

25. The light-emitting device as claimed in claim 1, further comprising peripheral electromagnetic shields disposed outside of the first and second substrates.

* * * * *